US005477570A

United States Patent [19]

Hannant et al.

[11] Patent Number: 5,477,570

[45] Date of Patent: Dec. 26, 1995

[54] OPERATING TABLES, TROLLEYS AND TRANSFER SYSTEMS

[75] Inventors: Keith Hannant, Rustington; Julie Strachan, Hove, both of England

[73] Assignee: Smiths Industries Public Limited Company, London, England

[21] Appl. No.: 238,523

[22] Filed: May 5, 1994

[30] Foreign Application Priority Data

May 15, 1993 [GB] United Kingdom ..... 9310057

[51] Int. Cl.[6] ..... A61G 7/10; A61G 7/00

[52] U.S. Cl. ..... 5/86.1; 5/81.1; 5/600; 5/613

[58] Field of Search ..... 5/81.1, 600, 601, 5/610, 613, 424, 86.1; 378/209

[56] References Cited

U.S. PATENT DOCUMENTS

| | | | |
|---|---|---|---|
| 4,387,473 | 6/1983 | Gettner | 5/81.1 |
| 4,613,997 | 9/1986 | Langdale | 5/202 |

FOREIGN PATENT DOCUMENTS

| | | |
|---|---|---|
| 0047958 | 3/1982 | European Pat. Off. . |
| 1322712 | 2/1963 | France . |
| 2525702 | 10/1983 | France . |
| 2815763 | 10/1979 | Germany . |
| 1416697 | 12/1975 | United Kingdom . |
| 85/01646 | 4/1985 | WIPO . |

*Primary Examiner*—Alexander Grosz
*Attorney, Agent, or Firm*—Pollock, VandeSande and Priddy

[57] ABSTRACT

A transfer trolley for transferring a patient onto an operating table has a removable patient support platform divided across its length into two parts coupled by a hinge. A rod and cylinder mounted at their ends to respective parts of the platform are lockable to lock the two parts of the platform and prevent bending at the hinge while on the trolley. The trolley has two arms for supporting the platform, which either extend laterally under the platform on opposite sides of the hinge or longitudinally and traversing the region of the hinge. A control unit on the trolley has infra-red emitters that emit signals to sensors on the table, to control operation of the table, only when the trolley is correctly located for transfer.

5 Claims, 2 Drawing Sheets

OPERATING TABLES, TROLLEYS AND TRANSFER SYSTEMS

BACKGROUND OF THE INVENTION

This invention relates to operating tables, to patient transfer trolleys and to systems including such tables and trolleys.

Instead of lifting a patient off a trolley and onto an operating table, it is common practice for the top, or patient support platform, of the trolley to be removable so that this can be transferred onto the operating table support column. The platform is then used to support the patient during surgery and is articulated and displaceable by means of the operating table controls. After surgery, the patient support platform is moved back onto the trolley so that the patient can be transferred to the recovery room. This arrangement minimizes disturbance of the patient and reduces the amount of lifting that needs to be done by theatre staff.

The patient support platform is usually supported by the trolley and the operating table at the hinge point of the platform, that is, the point at which the two ends of the platform form an acute or obtuse angle when the ends are raised or lowered relative to one another. One problem with this arrangement is that different platforms are needed for side loading and for end loading.

Another problem with these transfer systems is in controlling the loading and unloading operations. It is possible in some systems for the user to start loading or unloading of the table before the trolley is in the correct position. This can lead to damage or injury.

BRIEF SUMMARY OF THE INVENTION

It is an object of the present invention in its various objects to provide an improved operating table, trolley and transfer system.

According to one aspect of the present invention there is provided a transfer trolley for use in transferring a patient onto an operating table, the trolley including a removable patient support platform that is divided across its length into two parts coupled at a hinge, and lockable means that is operable to lock the two parts to prevent bending at the hinge while on the trolley, and the trolley including means for supporting the platform at locations spaced along the platform on opposite sides of the hinge.

The trolley may include two parallel arms that are adapted to extend laterally under the table on opposite sides of the hinge to support the platform. Alternatively, the two parallel arms may be adapted to extend longitudinally under the platform and to traverse the region of the hinge. The trolley base may be of U shape having two feet extending parallel with the arms, the feet being spaced from one another at one end and joined together by a cross-piece towards the other end. The lockable means may include a rod and cylinder mounted at their ends to respective parts of the platform, the rod being slidable in the cylinder and the lockable means including means for locking the rod relative to the cylinder. The trolley may include a control unit and means supplying signals from the control unit to an operating table to control operation of the operating table. The means for supplying signals from the control unit are preferably arranged so that signals are only received by the operating table when the trolley is in the correct position to transfer the patient support platform to or from the operating table. The means for supplying signals is preferably an infra-red emitter arranged to supply signals to an infra-red sensor on the operating table.

According to another aspect of the present invention there is provided a patient transfer system including an operating table and a trolley according to the above aspect of the present invention.

The operating table may have a control unit controlled by a handset, the operating table having means for supporting the handset during transfer of the patient support platform to or from the trolley, the operating table being arranged to prevent control of the operating table by the control unit on the trolley unless the handset is correctly supported by the support means.

According to a further aspect of the present invention there is provided an operating table for a system according to the above other aspect of the invention.

An operating table, trolley and transfer system, in accordance with the present invention will now be described, by way of example, with reference to the accompanying drawings.

DETAILED DESCRIPTION OF A PREFERRED EMBODIMENT OF THE INVENTION

Figure 1:
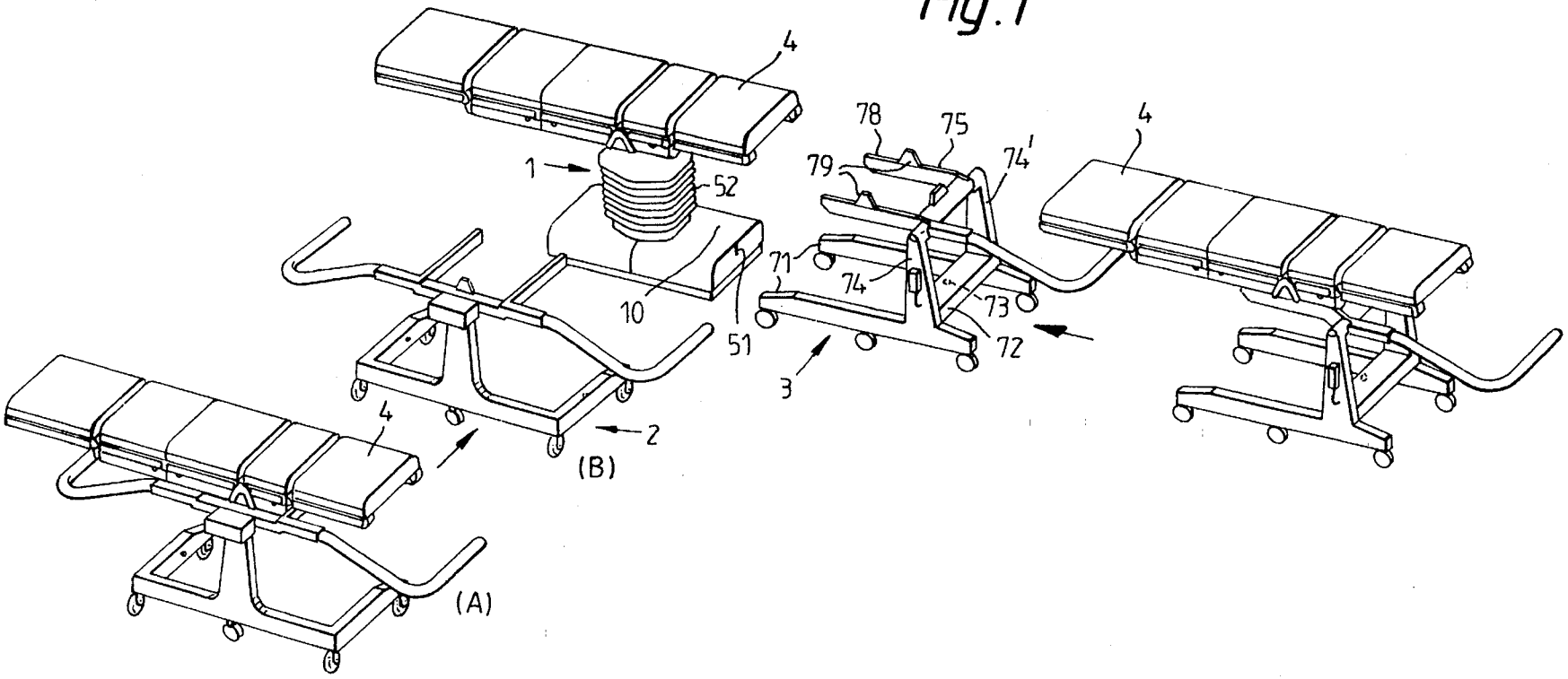
FIG. 1 is a perspective view of the system.

With reference first to FIG. 1 there is shown an operating table 1 used with a side-loading trolley 2 and an end-loading trolley 3. The side-loading trolley 2 is illustrated in position (A) carrying the patient support platform 4. The patient is placed on the platform 4 and is moved to the operating theatre by means of the trolley 2. The trolley 2 is moved in position over the operating table, which is then raised to lift the platform off the trolley. Locks on the operating table engage the platform 4 to retain it in position. The trolley 2 is then moved back to position (B) where it is shown without the platform 4. The end-loading trolley 3 is used similarly.

Figure 2:
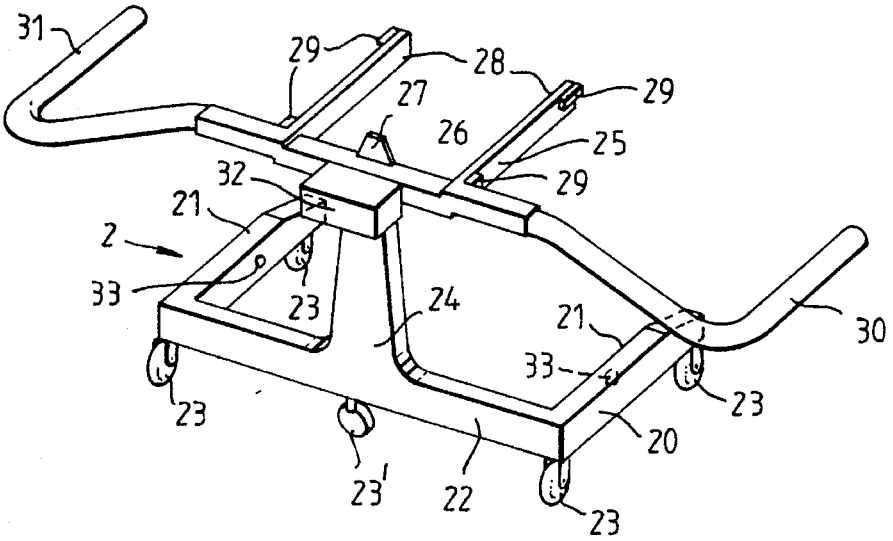
FIG. 2 is a perspective view of the trolley.

With reference now to FIG. 2, the trolley 2 has a U-shape metal base 20 formed by two parallel feet 21 joined at one end by a cross-piece 22. The base 20 has four wheels or castors 23, one at each corner. A fifth castor 23' is located midway along the cross-piece 22, this castor being lockable in orientation in order to help guide the trolley in straight lines when it is being pushed. The internal length of the base 20, between the feet 21 is selected to be slightly greater than the length of the base 10 of the operating table. A vertical pillar 24 projects from the center of the cross-piece 22 to a height just exceeding the lowest height setting of the operating table column 52. At the upper end of the pillar 24 there is a platform support frame 25, which is of U-shape and extends horizontally from the pillar over the base 20. The frame 25 has a cross-piece 26 that extends parallel with the cross-piece 22 of the base and projects an equal distance on opposite sides of the pillar 24. Centrally of the cross-piece 26 there is a wedge-shape member 27 that projects vertically upwards. The frame 25 also has two arms 28 extending parallel to one another at fight angles to and at opposite ends of the cross-piece 26. Both arms have two sockets 29 at their ends that receive locking pins from the platform 4. The trolley 2 also has two L-shape manoeuvring bars 30 and 31, which extend longitudinally and down from the upper, platform support frame 25 at opposite ends of the trolley. These are used to push and pull the trolley and do not support the platform 4.

The trolley 2 also includes a hand-held control unit 32 used to control up and down operation of the table 1. The control unit 32 is battery powered and provides an output to two short-range infra-red emitters 33 located on the inside of the feet 21 midway along their length. Operation of the control unit 32 will be described later.

Figure 3:
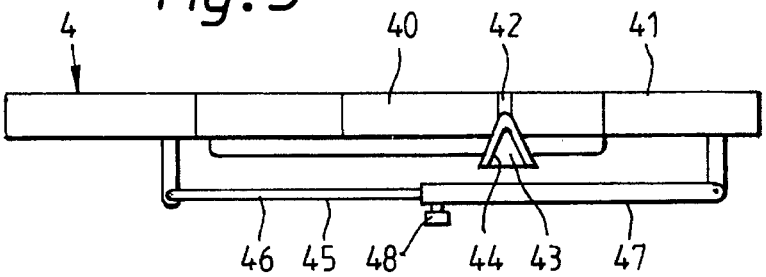
FIG. 3 is a side elevation view of a patient support platform.
Figure 4:
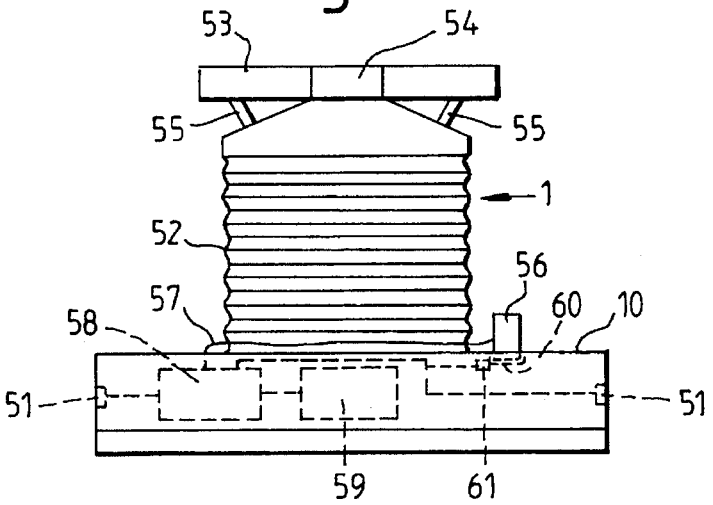
FIG. 4 is a side elevation view of the operating table.

With reference now to FIG. 3, the patient support 4 has two leaves 40 and 41 linked together by a lateral hinge 42 so that the two leaves can each be displaced up or down about the hinge axis. At opposite ends of the hinge 42 there are two support plates 43 having wedge-shape recesses 44 on their outer surfaces; these recesses are of the same shape as the member 27. On their inner surfaces, the plates 43 both have locking recesses that receive a laterally-expandable bolt (not shown) from the table 1, which serves to lock the platform on the table. The platform 4 also has a locking mechanism 45 connected between the two leaves 40 and 41 so that they can be locked relative to one another to prevent bending at the hinge 42. The locking mechanism 45 may take various different forms. In the example illustrated, it comprises a rod 46 and a cylinder 47 pivotally mounted at their ends with respective leaves 40 and 41. The rod 46 is slidable inside the cylinder and can be locked relative to the cylinder by means of a lock 48. Alternative locking mechanisms include an hydraulic or pneumatic damper cylinder that prevents relative movement when a vent in the cylinder is closed but allows relative movement when the vent is open. In normal use of the operating table 1, the locking mechanism 45 is unlocked so that the two leaves 40 and 41 can be moved freely relative to one another. When the platform 4 is on the trolley 2, the locking mechanism 45 is locked. This is necessary to ensure that the platform does not fold at the hinge 42 during transfer since the two arms 28 of the trolley extend laterally under the platform on opposite sides of the hinge. With the end-loading trolley 3 the two arms 78 extend longitudinally under the platform and traverse the region of the hinge 42.

The operating table 1 has a rectangular base 10 that sits on the floor. At opposite ends of the base 10 there are two infra-red sensors 51 positioned to be alongside the emitters 33 on the trolley 2 when the trolley is in the correct position relative to the table. A column 52 extends upwardly from the base 10 and has at its upper end an articulated platform retainer 53 by which the various movements of the parts of the platform are effected. The retainer 53 has a lock 54 that locks the platform 4 to the table 1. The column 52 contains various hydraulic actuators 55 linked to the retainer 53. The table 1 has a conventional handset 56 used to move the platform up and down and to cause the usual tilting movements of the platform 4 and its two leaves 40 and 41. The handset 56 is connected via a cable 57 to a control unit 58 in the base 10, which also contains an hydraulic power supply 59 for the table. The handset 56 can be held in the hand by the surgeon or other theatre staff when movement of the table is required. At other times, the handset 56 sits in a receptacle 60 on the table. The receptacle 60 includes a sensor 61 responsive to the handset 56; the sensor provides a signal to the control unit 58 to indicate whether or not the handset is in the receptacle.

To load a patient onto the operating table 1, the table column 52 is first lowered to its full extent by using the table handset 56. The handset 56 is then placed in the receptacle 60. The trolley 2, with the platform 4 supporting the patient, is then pushed up to the operating table 1 so that its feet 21 extend either side of the base 10 and so that the cross-piece 22 abuts the longitudinal side of the base. In this position, the platform 4 is located correctly above the table 1 and its platform retainer 53 and the emitters 33 are located in register with the sensors 51 on the base. The next step is to raise the column 52 of the table 1 so that the platform 4 is lifted off the trolley 2 and is locked onto the retainer 53 of the table. This is carried out by means of the trolley's control unit 32. Actuation of the UP key on the control unit 32 causes coded emissions of infra-red pulses from the emitters 33, which are received by the sensors 51. The sensors 51 supply signals to the control unit 58 in the base 10 causing the control unit to raise the column 52. This only happens if the control unit 58 in the base 1 receives a signal from the receptacle sensor 61 to indicate that the table handset 56 is correctly stowed. This feature ensures that the table 1 is only controlled by one person during transfer and ensures that the cable 57 of the table handset 56 is not trapped during transfer. Because the control unit 32 can only control the table 1 when the trolley 2 is correctly positioned, it reduces the risk of the platform being incorrectly loaded into the table or onto the trolley. When the weight of the platform 4 is taken by the table retainer 53, the platform is automatically locked to the retainer by the expanding bolt in the lock 54. The trolley 2 is then removed and the table is controlled in the usual way using its handset 56. The control unit 32 on the trolley 2 becomes ineffective as soon as the trolley is moved away from the table because the sensors 51 in the base 10 no longer respond to the emitters 33.

When surgery has been completed, the table 1 is raised so that the trolley 2 can be moved under the platform 4. Again, the handset 56 of the table is placed in the receptacle 60 before the trolley is moved into position. Lowering of the table is controlled by the control unit 32 on the trolley 2.

The platform 4 can also be transferred using the end-loading trolley 3. This is similar in construction to the side-loading trolley 2 except that it has two pillars 74 and 74' supporting the patient support frame 75. The separation between the feet 71 of the trolley 3 is less than with the other trolley 2 and just greater than the width of the base 10 of the table 1. The trolley 3 has one emitter 73 located centrally of the cross-piece 72 between the two feet. In use, the platform 4 is supported by means of wedge-shape members 79 on the arms 78, which locate in the wedge-shape recesses 44 on the platform.

What we claim is:

1. A transfer trolley for transferring a patient onto an operating table, said trolley comprising: a base for supporting the trolley on the floor; a removable patient support platform, the platform having a hinge and being divided across its length into two parts coupled at said hinge; lockable means operable to lock said two parts to prevent bending at said hinge while on the trolley; and support means for supporting the platform at locations spaced along the platform on opposite sides of said hinge.

2. A trolley according to claim 1, wherein said support means includes two parallel arms extending laterally under said platform on opposite sides of said hinge.

3. A trolley according to claim 1, wherein said support means includes two parallel arms extending longitudinally under said platform and traversing a region of said hinge.

4. A trolley according to claim 1, wherein said support means includes two parallel arms extending under said platform, wherein said base is of U shape having two feet extending parallel with said arms, and wherein said feet are spaced from one another at one end and joined together by a cross-piece towards an opposite end.

5. A trolley according to claim 1, wherein said lockable means includes a rod, a cylinder and means mounting the rod and cylinder at their ends to respective ones of said parts of said platform, wherein said rod is slidable in said cylinder, and wherein said lockable means includes means for locking said rod relative to said cylinder.

* * * * *